US005749165A

United States Patent [19]

Schönborn et al.

[11] Patent Number: 5,749,165

[45] Date of Patent: May 12, 1998

[54] ELECTRIC PRESSING IRON WITH COATED SOLEPLATE

[75] Inventors: Hartmut Schönborn, Neu-Anspach; Günther Alschweig, Eschborn; Hans-Herbert Fuchs, Hofheim; Andrea Hahnewald, Dreieich, all of Germany; Augustin Auria, Esplugues de Llobregat, Spain; Joseph Recarsens Carcia, Barcelona, Spain

[73] Assignee: Braun Aktiengesellschaft, Kronberg, Germany

[21] Appl. No.: 720,407

[22] Filed: Sep. 27, 1996

Related U.S. Application Data

[63] Continuation of PCT/EP95/00177, Mar. 29, 1995.

[30] Foreign Application Priority Data

Apr. 6, 1994 [DE] Germany ..... 44 11 790.6

[51] Int. Cl.[6] ..... D06F 75/38; C23C 10/02

[52] U.S. Cl. ..... 38/93; 29/904; 427/126.3

[58] Field of Search ..... 38/74, 93; 219/245; 427/58, 327, 405, 419.2, 527, 528, 531, 534, 126.3, 126.4, 209; 29/904, DIG. 29, DIG. 5, DIG. 12, DIG. 19, DIG. 26

[56] References Cited

U.S. PATENT DOCUMENTS

| | | | |
|---|---|---|---|
| 2,298,113 | 10/1942 | Ely | 38/93 |
| 2,846,793 | 8/1958 | Studer | 38/93 X |
| 4,658,520 | 4/1987 | Henneberger et al. | 38/93 |
| 4,862,609 | 9/1989 | Ullrich et al. | 38/93 |
| 5,619,813 | 4/1997 | Forest et al. | 38/93 |

FOREIGN PATENT DOCUMENTS

| | | |
|---|---|---|
| A 0 217 014 | 4/1987 | European Pat. Off. . |
| 46 376 B | 9/1989 | European Pat. Off. . |
| A 2 648 166 | 12/1990 | France . |
| 36 17 034 A1 | 4/1987 | Germany . |
| 41 03 794 C1 | 5/1992 | Germany . |
| WO 93/09282 | 5/1993 | WIPO . |

*Primary Examiner*—Ismael Izaguirre

*Attorney, Agent, or Firm*—Fish & Richardson, P.C.

[57] ABSTRACT

An electric pressing iron in which a plate-shaped soleplate made of an aluminum material with a low silicon content is bonded to the iron body by a temperature-resistant adhesive, wherein the surface of the soleplate is provided with a hard and wear-resistant aluminum oxide coating. Because the soleplate is made of an aluminum material with a low silicon content, anodizing produces an aluminum oxide coating of a particularly uniform coloring, with a temperature-resistant as well as corrosion- and scratch-resistant ironing surface that affords particular economy of manufacture.

23 Claims, 1 Drawing Sheet

ELECTRIC PRESSING IRON WITH COATED SOLEPLATE

This application is a continuation of co-pending application PCT/EP 95.01177, filed Mar. 29, 1995.

BACKGROUND OF THE INVENTION

This invention relates to an electric pressing iron, including an iron body made of cast aluminum containing silicon and provided with an electric heating means, and a surface formed by an aluminum oxide coating and defining the ironing surface of the pressing iron.

The brochure "HART-COAT", AHC/83 issue, by the firm of A.H.C.-Oberflächentechnik München GmbH of 81369-München, Euckenstraβe 4, describes application examples relating to the surface protection of aluminum materials by means of an anodic oxidation, particularly a "HART-COAT" coating. As stated in this brochure, anodic oxidation produces a very hard aluminum oxide coating on the surface of the aluminum material, which coating is wear- and corrosion-resistant, hard, has good sliding properties and withstands the effects of high temperatures. The brochure further states that for the application of such oxide coatings to aluminum parts, "ironing soles" are, among other applications, also suitable (5th page of the brochure).

SUMMARY OF THE INVENTION

In accordance with the present invention, it is proposed producing this aluminum oxide coating by anodizing the soleplate, thereby transforming the surface of the soleplate into an aluminum oxide coating. For this purpose, a plate-shaped soleplate made of an aluminum material with a low silicon content is used, which is then attached to the iron body such as to have good thermal contact with the iron body. Using a soleplate made of aluminum with a low silicon content in accordance with the invention enables an aluminum oxide coating to be obtained which is superior in appearance, perfect and free from defects, and which—upon attachment to the iron body and completion to form a pressing iron—results in an electrically operable pressing iron which in respect of its ironing surface meets many of the requirements made on it, including resistance to corrosion and wear, very good hardness, good sliding ability, no problems of adhering to the material being ironed, good temperature resistance, high insulation, etc. By selecting aluminum as material, a particularly lightweight sandwich construction of iron body and soleplate results.

With the pressing iron constructed in accordance with the present invention, not only the above-mentioned advantages may be achieved, but also an ironing surface results which exhibits an extremely uniform coloring while having a high degree of purity and a good surface quality. A soleplate with a coating of such high quality, in addition to affording low-cost quantity production, also affords relative ease of attachment to the iron body. In particular, there is hardly any discoloration of the soleplate surface due to the effect of high temperatures and prolonged use, so that also the positive visual impression of the ironing surface is maintained unchanged for a long period of time.

Preferably, laminated rolled sheets of a wrought aluminum alloy are suitable, in particular of the aluminum-manganese-magnesium (AlMg 4.5 Mn), aluminum-magnesium (AlMg 3), aluminum-copper-magnesium (AlCuMg 1), etc. types. Rolled sheets of this type are practically silicon-free, enabling an absolutely homogeneous aluminum oxide coating to be produced. The amounts of alloying materials added to the aluminum should not be higher than 5%, preferably be lower than 3%.

The present invention provides for smoothing of the surface of the soleplate prior to the manufacture of the aluminum oxide coating, preferably to a roughness height less than or equal to 0.1 μm. Advantageously, this high surface finish may be accomplished, for example, by means of a grinding or polishing operation. Polishing or grinding the soleplate prior to the fabrication of an aluminum oxide coating has the advantage that, after fabrication of the soleplate with aluminum oxide, the amount of stock to be removed from the surface in order to achieve the specified final surface roughness is less than would be the case in the absence of a prior polishing or grinding operation. Because less material is removed, a relatively thin aluminum oxide coating may be selected, without the need to wear part of this hard coating away completely by a subsequent polishing operation, in order to obtain the desired roughness height. Thus, in spite of the surface roughness aimed at, a closed and consequently corrosion-protected aluminum oxide coating is obtained. The removal of aluminum from the soleplate prior to its being coated with aluminum oxide down to a roughness height of less than 0.1 μm may be effected extremely rapidly in practice, since the aluminum surface of the soleplate in uncoated and accordingly still very soft condition may be smoothed or machined with ease.

Preferably, an ironing surface is obtained which is capable of withstanding major loads without appreciable damage and is protected against corrosion extremely well. With a prior treatment of the surface of the soleplate in accordance with claim 3, even the smallest thickness (20 μm) of the aluminum oxide coating is still sufficient for the surface to be subsequently abraded down to a roughness height of less than 0.1 μm, without any bare spots being exposed locally.

Preferably, complete abrasion of the aluminum oxide coating in the area of the steam discharge ports is prevented from occurring during polishing of the surface of the aluminum oxide coating to the predetermined roughness height, considering that the polishing process removes a specifically substantially higher amount of material at the edges than it does on a planar, relatively smooth surface. Advantageously, the outer edge area of the soleplate has a radius greater than or equal to 0.3 mm, preferably 0.5 mm. The two approaches of the invention which include machining the surface of the bare soleplate, as by grinding or polishing, to a predetermined roughness height prior to fabricating the aluminum oxide coating, and providing the transition areas at the edges with a sufficiently round configuration, produce the result that also with a low thickness of the aluminum oxide coating the subsequent polishing operation will not wear away this material completely in the critical areas, such as at the edges. Moreover, a smaller amount of stock removal from a very hard aluminum oxide coating also reduces machining time.

In accordance with a further aspect of the invention, the individual steam discharge ports terminate in annular steps that are recessed relative to the ironing surface. Considering, however, that the diameters of the annular steps in the transition areas to the ironing surface are greater than the diameters of the recessed steam discharge ports, a larger radius may be selected at these locations. The larger radius of the edge area prevents that during the subsequent polishing operation at unchanged polishing speed the amount of aluminum oxide removed in this area is locally appreciably higher than in the planar areas of the ironing surface. By contrast, however, if the edge areas were sharp-edged, the aluminum oxide coating would be abraded down completely.

Preferably, several steam discharge ports open into a bead, so that the bead periphery merging with the surface of the soleplate encompasses a whole group of steam discharge ports, preferably between two and five. The outer periphery of the bead so formed allows a considerably greater curvature as well as a rounded peripheral area. This advantage, in turn, enables larger radii to be selected in the peripheral area of the bead, as a result of which the polishing operation treats the aluminum oxide coating in this peripheral area gently, that is, without wearing it down completely.

In accordance with a further aspect of the invention, a particularly scratch-and wear-resistant soleplate is provided. Preferably, a soleplate with a sufficiently good sliding ability without excessive adhesion is provided.

Preferably, an electrical ground connection of the soleplate to the iron body or to ground is ensured. These voids may be produced either by subsequently grinding the electrically non-conducting aluminum oxide coating, or by masking individual areas of the soleplate prior to its immersion in an acid bath, that is, prior to fabricating the aluminum oxide coating.

According to a method of manufacturing an electric pressing iron, the soleplate, prior to being coated with aluminum oxide may be pretreated in a particularly easy and economical manner by means of a grinding or polishing operation, because the bare aluminum surface is very soft and may be therefore machined to the specified roughness height within a minimum of time. This first machining operation reduces the surface roughness already at a stage before the aluminum oxide coating is applied, such that following application of the aluminum oxide coating, the resulting ironing surface requires very little subsequent treatment for roughness reduction. This results in substantially shorter polishing periods until the desired roughness height is reached on the very hard ironing surface which is the aluminum oxide coating, thereby reducing the cost of the soleplate.

In addition to this advantage, another advantage results in that in particular in the edge areas that are exposed to higher loads per unit area, the aluminum oxide coating is not worn away completely. It is precisely edges, as compared to planar and smooth surfaces, that in a polishing operation are exposed to higher surface loads by the grinding or polishing wheels or brushes, whereby the amount of abrasion of the aluminum oxide coating is necessarily higher in these areas at constant polishing speed. In order to counteract this disadvantageous phenomenon, either the polishing pressure could be reduced as the tool approaches the edges, which, however, is a very difficult task in practice, or—as shown in a further feature of the invention —the transition areas or edges could be rounded to such an extent that in the polishing operation the load per unit area decreases in these edge areas.

Preferably, the soleplate is bonded to the iron body particularly firmly. In this method, the steam discharge ports are at the same time sealed against the edge of the steam passageways formed in the iron body, thus ensuring that steam exits exclusively through the steam discharge ports. Still further, the adhesive coating of the silicone adhesive is so thin that as much heat as possible continues to be introduced from the iron body into the soleplate. As adhesive, a two-component adhesive is used to which aluminum oxide is admixed (in amounts of 70%, approximately). This establishes an intimate connection and provides for good heat conduction between the iron body and the soleplate.

Preferably, areas not to be provided with an aluminum oxide coating may be masked by a masking means during the anodizing operation. This obviates the necessity of subsequent operations to obtain electrically conducting voids.

An embodiment of the invention will be described in greater detail in the following with reference to the accompanying drawings.

DESCRIPTION OF THE PREFERRED EMBODIMENTS

Figure 1:
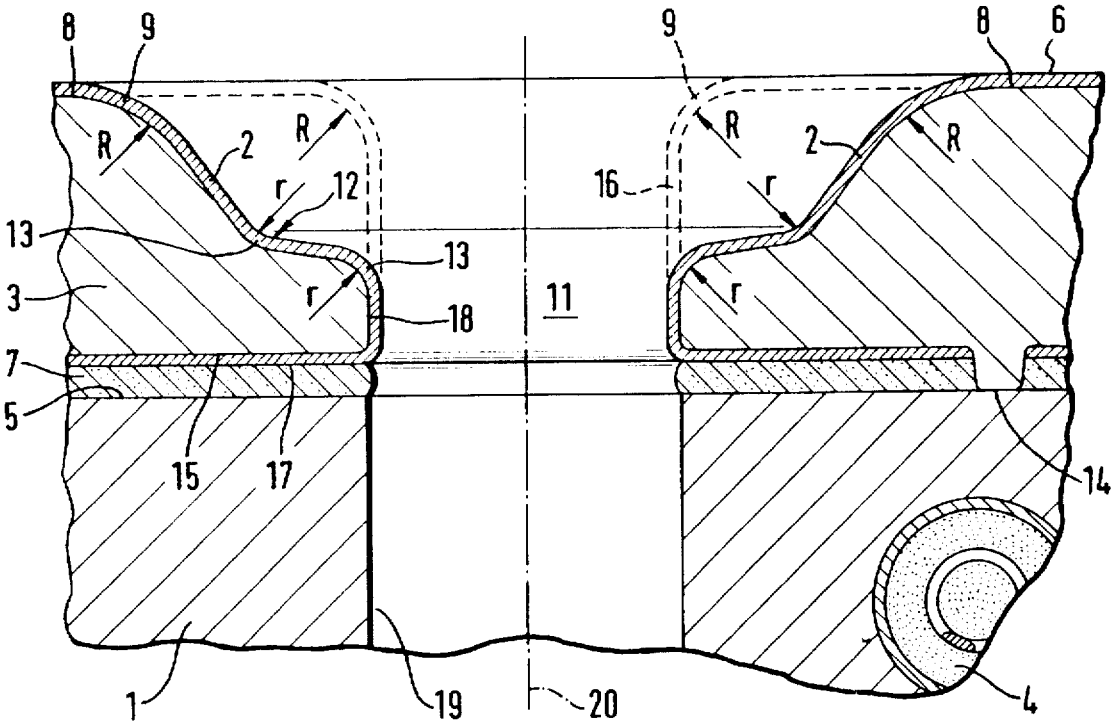
FIG. 1 is a partial sectional view, on an enlarged scale, of the layer construction of an iron body provided with a soleplate.

Referring now to FIG. 1 of the drawings, there is shown an iron body 1 constructed of pressure die cast aluminum and having steam discharge ports 11 which are distributed proximally to its peripheral edge and establish steam communication with the opening 19 formed in the iron body 1 and the steam generating chamber (not shown). As becomes apparent from FIGS. 1 to 4, the ironing surface 6 is shown face up as if the pressing iron was turned upside down, that is, turned by 180°. The iron body 1 is made of cast aluminum to which silicon is admixed for the purpose of improved material flow as it is cast in the die or some other mold.

An electric heating means 4 for heating the iron body 1 is cast integral with the iron body 1 of FIG. 1. A soleplate 3 stamped from rolled sheet is bonded to the surface 5 of the iron body 1 by means of a heat-resistant silicone adhesive 7 having good heat-conducting properties. In addition to the adhesive 7, mechanical fastening means may be provided as, for example, sheet-metal tabs formed on the soleplate 3, which for the purpose of attaching the soleplate 3 during assembly are bent such as to embrace the iron body 1 in positive engagement therewith, which is, however, not shown in the drawings. Among other functions, the adhesive 7 also serves to seal the soleplate 3 relative to the iron body 1 in the area of the steam discharge ports 11.

According to FIG. 1, the outer surface 15 of the soleplate 3 is provided with an aluminum oxide coating 2, which, with the exception of voids 14, preferably covers the whole outer surface 15. Following attachment of the soleplate 3 to the iron body 1, the voids 14 establish a metallic connection with the surface 5 of the iron body 1.

All of the steam discharge ports 11 terminate in openings 19 which are formed in the iron body 1 and may have a common longitudinal axis 20. It is, however, also conceivable to provide the opening 19 in the form of an upwardly open passageway in which the steam discharge ports 11 terminate. This obviates the provision of individual steam bores in the iron body 1 to be connected with the steam discharge ports 11, thus facilitating the manufacture of the iron body 1 during the process of casting the iron body 1 or enabling a less intricate mold to be used. Adjoining the steam discharge port 11 via an edge area 13 is a bead 12 that surrounds the steam discharge port 11 and merges, via the edge area 9 of a radius R, with the horizontally extending surface 8 of the soleplate 3. In the absence of a peripheral bead 12, the steam discharge port 11 may also merge directly with the surface 8 of the soleplate 3 via radius R, as indicated schematically in FIG. 1 by the dashed lines 16.

Figure 2:
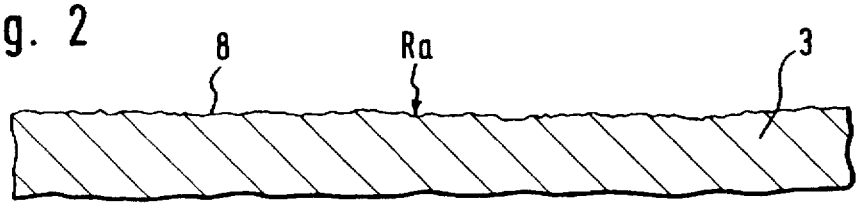
FIG. 2 is a partial longitudinal sectional view of the surface of the soleplate as it appears following the first surface finishing operation.
Figure 3:
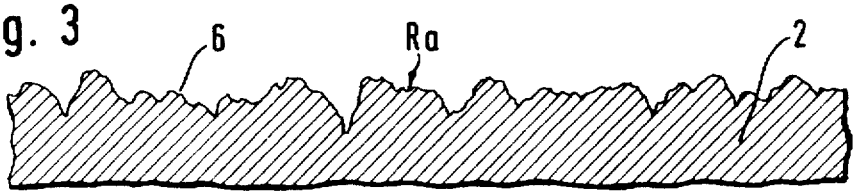
FIG. 3 is a partial longitudinal sectional view of the surface of the soleplate as it appears following application of the anodic coating.
Figure 4:
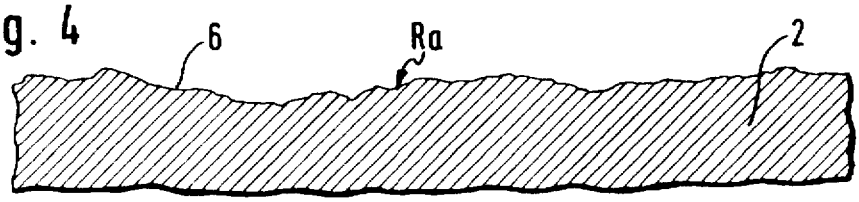
FIG. 4 is a partial longitudinal sectional view of the surface of the soleplate as it appears following polishing of the surface of the anodic coating.

FIG. 2 is a partial longitudinal cross-sectional view on an enlarged scale, showing the soleplate 3 in the area of its outer surface 8, yet in a condition as it appears following the first grinding or polishing operation of the surface 8, but still prior to anodizing the surface 8. FIG. 3 is a cross-section of the surface 6 of the aluminum oxide coating 2 on the soleplate 3, as it results on the surface 8 of the soleplate 3 upon immersion of the soleplate 3 of FIG. 2 in an anodic bath (not shown). The resulting roughness height Ra is even lower than it would be if the surface 8 of the soleplate 3 had not been ground or polished in a prior operation according to FIG. 2. FIG. 4 is a cross-section of the surface 6 of the aluminum oxide coating 2, as it results from polishing the surface of the aluminum oxide coating 2 of FIG. 3.

The method of manufacturing the soleplate is as follows:

To begin with, the surface 5 of the iron body 1 is sized as by face-pressing, and washed in an alkaline solution for degreasing, with the roughness height of the surface 5 being greater than 1 μm for improved adhesion of the adhesive 7. In operations independent thereof, the soleplate 3 is stamped from rolled sheet of a low silicon content, and the area around the steam discharge ports 11 is embossed, deep-drawn or otherwise deformed depending on the configuration of the annular groove or bead, while at the same time also forming the transition areas to the desired radii R and r of 0.5 to 1 mm, approximately.

Independently thereof, the outer surface 8, which at a later stage serves as base for the ironing surface 6, is ground or polished according to FIG. 2 until a roughness height Ra not exceeding 1 μm results, as specified in the invention.

Subsequently, the soleplate 3 is immersed in an anodic bath (not shown), producing on the outer surface 8 of the soleplate 3 an aluminum oxide coating 2 of a thickness of preferably between 35 and 45 μm and a Vickers hardness of preferably 480 DPH 0.5. If it is desired to leave particular areas on the outer surface 15 uncoated with aluminum oxide 2, as, for example, the voids 14, these areas are masked as by wax, enamel, silicone, or some other masking means. In this manner, these areas 14 are not affected by aluminum oxide 2. Degreasing or cleaning operations are applied depending on the individual requirements preceding or following each operation.

Subsequent to the anodic bath which lasts about until the roughness value Ra of 0.5 μm as illustrated in FIG. 3 is obtained on the surface 6 of the aluminum oxide coating 2, a polishing operation is performed in which the surface 6 of the aluminum oxide coating 2 is polished to the roughness height Ra of less than 0.1 μm, as illustrated in FIG. 4. Then the upper face 17 to be bonded to the iron body 1 is provided with a temperature-resistant silicone adhesive 7 having good heat conducting properties, and is pressed onto the surface 5 of the iron body 1. At the same time, additional sheet-metal tabs (not shown) formed on the soleplate 3 may be bent to such an extent as to embrace the iron body 1 in a positive-engagement relationship therewith. In this manner, the soleplate 3 is also mechanically connected with the iron body 1, in addition to the bond formed by the adhesive 7.

The soleplate 3 including the iron body 1 thus completed is then ready for assembly with the further necessary parts (not shown) to form a pressing iron. In operation of the pressing iron, the electric heating means 4 cast integral with the iron body 1 during the process of casting the iron body generates heat which enters the soleplate 3 on passing through the adhesive 7 and the aluminum oxide coating 2 adjacent to the adhesive 7, whence this heat is once again transferred through the outer aluminum oxide coating 2 to the ironing surface 6. During ironing, heat is transferred from this surface to the material being ironed, such as clothes, not shown in the drawings. Because the adhesive 7 is a good heat conductor and in intimate contact with the soleplate 3, heat transference to the soleplate 3 is good.

What is claimed is:

1. An electric pressing iron, comprising an iron body made of cast aluminum containing silicon; an electric heater; and a plate-shaped soleplate made of an aluminum material with a low silicon content attached to said iron body such as to be in good thermal contact with said iron body, wherein an outer surface of the soleplate defines an ironing surface, said ironing surface provided with an aluminum oxide coating produced by anodizing.

2. The electric pressing iron as claimed in claim 1, wherein said soleplate is made of a rolled sheet material.

3. The electric pressing iron as claimed in claim 2, wherein the outer surface of the soleplate is machined to a roughness height Ra less than or equal to 0.1 μm, prior to the fabrication of the aluminum oxide coating.

4. The electric pressing iron as claimed in claim 3, wherein the roughness height Ra is greater than or equal to 0.06 μm.

5. The electric pressing iron as claimed in claim 3, wherein said aluminum oxide coating has a thickness of between 20 and 80 μm.

6. The electric pressing iron as claimed in claim 5, wherein said aluminum oxide coating has a thickness of between 35 and 45 μm.

7. The electric pressing iron as claimed in claim 5, wherein said soleplate further having steam discharge ports extending through the soleplate, said discharge ports having edge areas rounded in the transition areas to the outer surface of the soleplate, the rounding having a radius R greater than or equal to 0.3 mm.

8. The electric pressing iron as claimed in claim 7, wherein said rounded edges have a radius R greater than or equal to 0.5 mm.

9. The electric pressing iron as claimed in claim 7, wherein said steam discharge ports are surrounded in the direction of the edge area by an annular step recessed relative to the ironing surface.

10. The electric pressing iron as claimed in claim 9, wherein several steam discharge ports are encompassed by a bead recessed relative to the ironing surface, the transition area of the bead being rounded in the direction of both the steam discharge ports and the outer surface of the soleplate, the edge area of the bead having a radius R greater than or equal to 0.3 mm.

11. The electric pressing iron as claimed in claim 10, wherein the edge area of said bead has a radius R greater than or equal to 0.5 mm.

12. The electric pressing iron as claimed in claim 1, wherein said aluminum oxide coating has a Vickers hardness of between 400 and 600 HV 0.5.

13. The electric pressing iron as claimed in claim 5, wherein the surface of the aluminum oxide coating has a roughness height Ra less than or equal to 0.1 μm.

14. The electric pressing iron as claimed in claim 13, wherein said aluminum oxide coating has a roughness height Ra higher than 0.06 μm.

15. The electric pressing iron as claimed in claim 1, wherein the outer surface of the soleplate, having at least one protrusion, is completely coated, with the exception of said at least one protrusion, with aluminum oxide, wherein said at least one protrusion is connected to the iron body in an electrically conducting fashion.

16. A method of manufacturing an electric pressing iron having a soleplate and an iron body, the method comprising the steps of producing the soleplate by:

a) machining an outer surface of a rolled sheet by means of a surface treatment operation, such that a roughness height of Ra lower than or equal to 0.1 μm results;

b) anodizing by using a chemical oxidation process the surface of the rolled sheet to form an aluminum oxide coating of a thickness of between 20 and 80 μm;

c) machining the aluminum oxide coating by a polishing operation such as to obtain a roughness height Ra lower than 0.12 μm;

and after machining the aluminum oxide coating, attaching the soleplate to an iron body by a joining means.

17. The method as claimed in claim 16, wherein the step of attaching comprises bonding said soleplate to the surface of the iron body by a temperature-resistant silicone adhesive.

18. The method as claimed in claim 16, wherein at least a partial area of the outer surface of the soleplate is masked during the anodizing operation, such that this partial area defines an electrically conducting protrusion following anodizing.

19. The method as claimed in claim 16, wherein the step of machining prior to the step of transforming includes machining the outer surface of said rolled sheet to a surface roughness lower than or equal to 0.06 μm.

20. The method as claimed in claim 19, wherein the step of transforming includes transforming said outer surface to an aluminum oxide coating of a thickness between 35 and 45 μm.

21. The method as claimed in claim 20, wherein the step of machining after the step of transforming includes machining the aluminum oxide coating to obtain a roughness height Ra lower than 0.06 μm.

22. The method as claimed in claim 16, wherein the step of machining prior to the step of transforming includes grinding the outer surface of said rolled sheet.

23. The method as claimed in claim 16, wherein the step of machining prior to the step of transforming includes polishing the outer surface of said rolled sheet.

* * * * *